US011490191B1

(12) United States Patent
Backman

(10) Patent No.: US 11,490,191 B1
(45) Date of Patent: Nov. 1, 2022

(54) ACOUSTIC HORN AND SPEAKER MODULE

(71) Applicant: AAC Microtech (Changzhou) Co., Ltd., Changzhou (CN)

(72) Inventor: Juha Backman, Tampere (FI)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/336,352

(22) Filed: Jun. 2, 2021

(51) Int. Cl.
*H04R 1/30* (2006.01)
*H04R 1/02* (2006.01)

(52) U.S. Cl.
CPC ..... *H04R 1/30* (2013.01); *H04R 1/025* (2013.01); *H04R 2400/11* (2013.01); *H04R 2499/11* (2013.01)

(58) Field of Classification Search
CPC ..... H04R 1/30; H04R 1/025; H04R 2400/11; H04R 2499/11
USPC ..... 381/334
See application file for complete search history.

(56) References Cited

U.S. PATENT DOCUMENTS

| | | | | |
|---|---|---|---|---|
| 9,473,848 | B2 * | 10/2016 | Chick | H04R 1/2853 |
| 10,531,183 | B2 * | 1/2020 | Halley | H04R 1/025 |
| 2016/0119718 | A1 * | 4/2016 | Yang | H04R 1/24 381/351 |
| 2019/0215602 | A1 * | 7/2019 | Halley | H04R 1/24 |
| 2021/0105557 | A1 * | 4/2021 | Blore | H04R 1/2865 |

* cited by examiner

*Primary Examiner* — Sean H Nguyen
(74) *Attorney, Agent, or Firm* — W&G Law Group

(57) ABSTRACT

A acoustic horn includes an input port configured to acoustically couple with a front cavity of a loudspeaker, a pair of output ports leading to exterior of the horn, and a pair of channels each communicating the input port with a corresponding output port. Each of the channels has a cross section of which the area increases gradually in a direction from the input port to a corresponding output port and the areas of the cross sections of the channels in the same plane are substantially equal to each other such that the channels are acoustical symmetrical, which improves the high-frequency performance the sound waves and reduces distortion of the sound waves at low frequencies.

16 Claims, 10 Drawing Sheets

ACOUSTIC HORN AND SPEAKER MODULE

FIELD OF THE INVENTION

The present disclosure relates to the field of speakers, and in particular to a speaker module with an acoustic horn.

BACKGROUND

With the continuous improvement of people's living standards, higher requirements ha ve been placed on sound quality of micro-speakers used in portable devices, such as mobile phones and tablets. The common problem of conventional thin micro-speakers comprising a front cavity on top of the speaker and a narrow port leading to the exterior of the portable device is that it is very difficult to achieve a practical design with cavity/port combination that would generate a resonance frequency sufficiently high to ensure reproduction of the full audio range (up to 20 kHz). Conventional acoustic horns used so far with portable devices are intended usually as accessories, such as stands or covers, so they take significant space. The conventional acoustic horns do not precisely match with the driver, so they only increase the efficiency of the speaker at midrange frequencies and fail to provide high-frequency extension. Conventional cavity/port structures for extended high frequency response would require a very short and wide port, which is not suitable for some portable devices.

Therefore, it is desired to provide an improved loudspeaker which can overcome at least one of the above problems.

SUMMARY

Accordingly, the present disclosure is directed to an improved acoustic horn and a loudspeaker with the improved acoustic horn.

In one aspect, the present disclosure provides an acoustic horn which comprises an input port configured to acoustically couple with a front cavity of a loudspeaker, a pair of output ports leading to exterior of the horn, and a pair of channels each communicating the input port with a corresponding output port. Each of the channels has a cross section of which the area increases gradually in a direction from the input port to a corresponding output port and the areas of the cross sections of the channels in the same plane are substantially equal to each other such that the channels are acoustical symmetrical.

In some embodiment, the cross section is rectangle and comprises a pair of width edges and a pair of depth edges, and sizes of the width edges of the cross sections of the channels located at the same plane are substantially equal to each other.

In some embodiment, the sizes of the width edges increase gradually in the direction from the input port to the corresponding output port.

In some embodiment, the sizes of the depth edges increase gradually in the direction from the input port to the corresponding output port.

In some embodiment, each of the channels comprises a pair of spaced side walls and a pair spaced connecting walls respectively connected between opposite ends of the side walls, a path is formed between the side walls and the connecting walls, and at least one of the side walls and the connecting walls is curved or bent with at least one bending portion.

In some embodiment, each of the channels comprises a pair of side walls and a pair connecting walls respectively connected between opposite ends of the side walls, and a space is formed between adjacent two side walls of the channels.

In some embodiment, at least one of the adjacent two side walls of the channels is curved and a distance between the adjacent two side walls of the channels decreases gradually in the direction.

In some embodiment, ends of the adjacent two side walls of the channels close to the output ports are connected to each other.

In some embodiment, the acoustic horn is structurally symmetrical about a middle line between the channels.

In some embodiment, the acoustic horn is structurally asymmetrical about a middle line between the channels.

In some embodiment, ends of the adjacent two side walls of the channels close to the output ports are spaced from each other.

In some embodiment, portions of the channels adjacent to the input port are structurally symmetrical and other portions of the channels away from the input port have the same shape.

In some embodiment, the acoustic horn further comprises at least one extension cavity communicated with the input port and a sound absorptive layer is covered on a side of the extension cavity.

In another aspect, the present disclosure provides a loudspeaker module which comprises a loudspeaker and an acoustic horn attached to the loudspeaker. The loudspeaker comprises a front cavity with holes communicating with the front cavity, a rear cavity; and a driver located between the front cavity and the rear cavity. The acoustic horn comprises an input port communicated with the front cavity via the holes, a pair of output ports leading to exterior of the acoustic horn; and a pair of channels each communicating the input port with a corresponding one of the output ports. The channel has a cross section of which the area increases gradually in a direction from the input port to the corresponding output port and the areas of the cross sections of the channels in the same plane are substantially equal to each other.

In some embodiments, the cross section is rectangle and comprises a pair of width edges and a pair of depth edges, sizes of the width edges increase gradually in the direction from the input port to the corresponding output port, and sizes of the width edges of the cross sections of the channels located at the same plane are substantially equal to each other In some embodiments, the acoustic horn is structurally symmetrical about a middle line between the channels.

In some embodiments, the acoustic horn is structurally asymmetrical about a middle line between the channels.

In some embodiments, each of the channels comprises a pair of side walls and a pair connecting walls respectively connected between opposite ends of the side walls, a space is formed between adjacent two side walls of the channels, and a distance between the adjacent two side walls of the channels decreases gradually in the direction.

In some embodiments, ends of the adjacent two side walls of the channels close to the output ports are connected to each other.

In some embodiments, ends of the adjacent two side walls of the channels close to the output ports are spaced from each other.

In some embodiments, one of the adjacent two side walls of the channels is parallel to a middle line between the channels and a distance between the middle line and the other of the adjacent two side walls of the channels decreases gradually in the direction.

In some embodiments, the horn further comprises a hollow mounting portion located between the channels which are connected to opposite sides of the mounting portion, and the input port is defined in another side of the mounting portion attached to the loudspeaker.

In some embodiments, the hollow mounting portion has a cavity with a height in a range of 0.7 mm to 1 mm.

In another further aspect, the present disclosure provides a portable electric device comprising the loudspeaker module described above. The electronic device comprises an enclosure defining an output hole and an inner frame, the inner frame and the loudspeaker module are disposed within the enclosure, and the inner frame comprises a passage communicating the output ports with the output hole.

In some embodiments, the device further comprises a sealing disposed between the enclosure and the inner frame, the sealing surrounding the output hole.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

Figure 1:
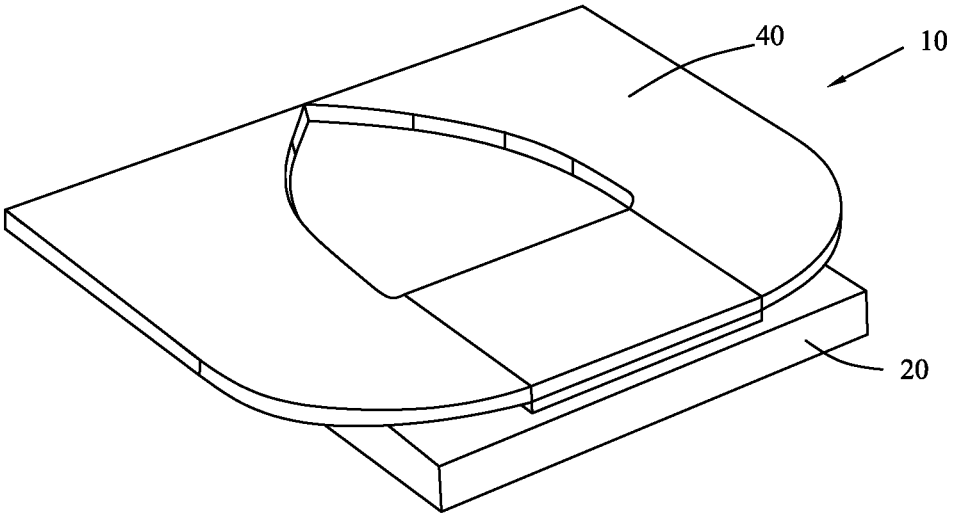
FIG. 1 is an isometric view of a loudspeaker module in accordance with an exemplary embodiment of the present disclosure.

The present disclosure will be further illustrated with reference to the accompanying drawings. It shall be noted that the elements of similar structures or functions are represented by like reference numerals throughout the figures. The embodiments described herein are not intended as an exhaustive illustration or description of various other embodiments or as a limitation on the scope of the claims or the scope of some other embodiments that are apparent to one of ordinary skills in the art in view of the embodiments described in the application. In addition, an illustrated embodiment need not have all the aspects or advantages shown.

Figure 2:
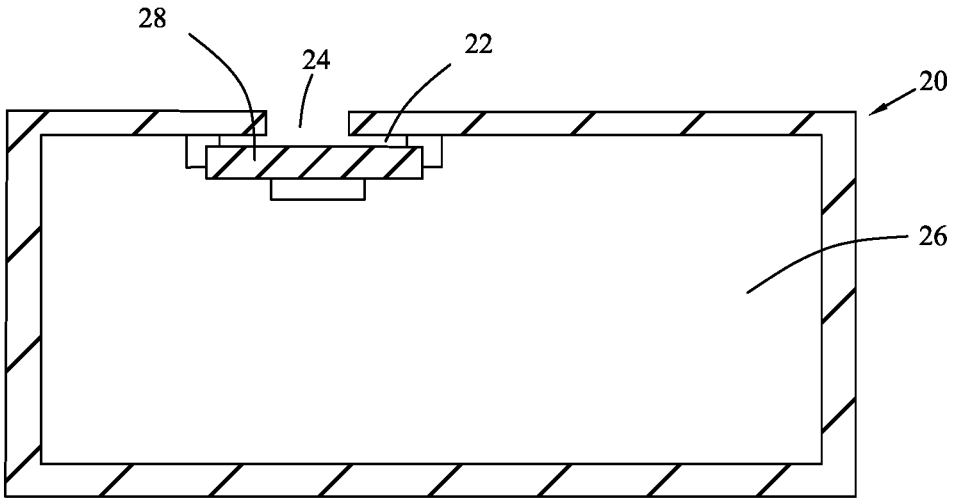
FIG. 2 is a cross sectional view of a loudspeaker in accordance with an exemplary embodiment of the present disclosure.

Referring to FIG. 1 to FIG. 2, a loudspeaker module 10 in accordance with an embodiment of the present disclosure comprises a loudspeaker 20 and an acoustic horn 40 attached to the loudspeaker 20. The loudspeaker 20 comprises a front cavity 22 with a sound hole 24 communicating with the front cavity 22, a rear cavity 26, and a driver 28 located between the front cavity 22 and the rear cavity 26.

Figure 3:
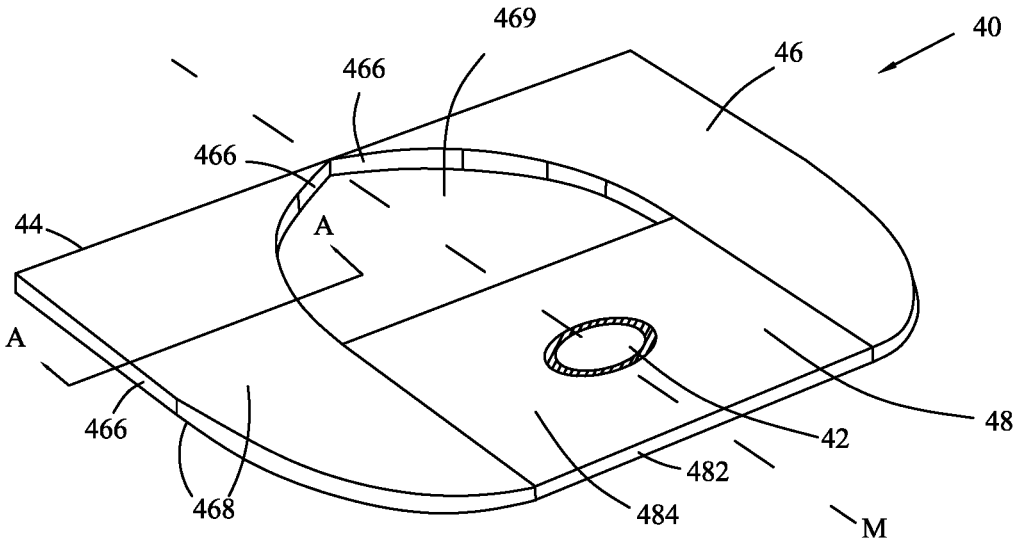
FIG. 3 is an isometric view of an acoustic horn in accordance with a first exemplary embodiment of the present disclosure.

Referring also to FIG. 3, the horn 40 comprises an input port 42 configured to communicate with the front cavity 22 of the loudspeaker via the sound hole 24, a pair of output ports 44 leading to exterior of the horn 40 and a pair of channels 46 each communicating the input port 42 with a corresponding one of the output ports 44.

Preferably, the channel 46 has a cross section of which the area increases gradually in a direction from the input port 42 to the corresponding output port 44, which both boosts the highest frequencies of sound waves generated by the loudspeaker 20 and makes the high frequency resonances of the sound waves less sharps. In the present disclosure, the cross section is perpendicular to the direction from the input port 42 to the corresponding output port 44.

Preferably, the areas of the cross sections of the pair of channels 46 located at the same plane are substantially equal to each other such that the two channels 46 are substantially acoustically symmetrical to each other. Thus, after the horn 40 is attached to the loudspeaker 20, the two substantially acoustically symmetrical channels 46 of the horn 40 are connected to the front cavity 22 of the loudspeaker 20 so that the quarter-wave resonance, which causes a wave dip and thus reduce the high frequency output, generated due to use of acoustically asymmetrical structure is avoided.

Figure 3A:
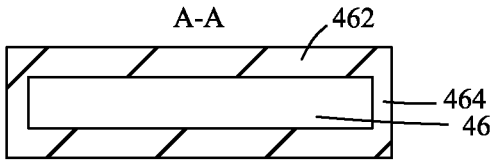
FIG. 3A is a cross sectional view, taken along line A-A of FIG. 3.

Referring to FIG. 3A, in some embodiments, the cross section of the channel 46 is rectangle and comprises a pair of width edges 462 and a pair of depth edges 464, size of the width edges 462 increase gradually in the direction from the input port 42 to the corresponding output port 44 and sizes of the depth edges 464 keep constant in the direction from the input port 42 to the corresponding output port 44. Sizes of the width edges 462 of the cross sections of the two channels 46 located at the same plane are substantially equal to each other.

Referring to FIG. 3 again, in some embodiments, the horn 40 further comprises a hollow mounting portion 48 configured to be mounted to the loudspeaker 20. The mounting portion 48 comprises a pair of spaced side walls 482 and a pair of spaced connecting walls 484 respectively connected between opposite ends of the side walls 482. The spaced side walls 482 and spaced connecting walls 484 cooperatively form a cavity therebetween. Preferably, the connecting walls 484 have a rectangle shape. When loudspeaker module 10 is used for mobile phones, the height of the cavity is preferably in a range of 0.7 mm to 1 mm. When loudspeaker module 10 is used for laptops, the height of the cavity may be greater than 1 mm. The depth of the mounting portion 48 may be greater than that of the channel 46 since long-throw drivers may require more clearance than what is available for the channel 46. The input port 42 is defined in one of the connecting walls 482 of the mounting portion 48 attached to the loudspeaker 20. The pair of channels 46 extend from opposite sides of the mounting portion 48 and communicates with the input port 42 via a passage formed inside of the mounting portion 48. Each of the channels 46 comprises a pair of spaced side walls 466 and a pair spaced connecting walls 468 respectively connected between opposite ends of the side walls 466. A space 469 is formed between adjacent two side walls 466 of the channels 46 and one of the side walls 482 of the mounting portion 48. Preferably, the mounting portion 48 and the channels 46 are integrally formed. Side walls 462, 482 of the channels 46 and the mounting portion 48 adjacent the space 269 are connected together to form a dome or arch shape. The distance between the adjacent two side walls 466 of the channels 46 decreases gradually in the direction from the input port 42 to the corresponding output port 44. Side walls of the channels 46 and the mounting portion 48 away from the space 269 are connected together to form a U shape. At least parts of the side walls 466 of the channels 46 are curved to increases the length and cross-section area of the channels 46, which improves the high-frequency performance and reduces distortion at low frequencies of the sound wave.

In some embodiments, ends of the adjacent two side walls 466 of the channels 46 close to the output ports 44 are connected to each other.

Figure 4:
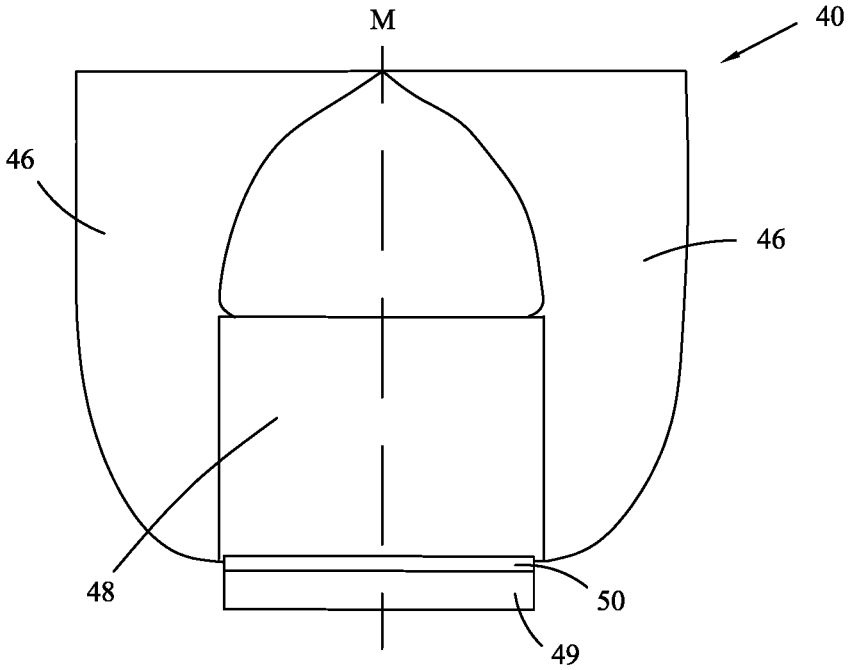
FIG. 4 is a plan view of the acoustic horn in accordance with a second exemplary embodiment of the present disclosure.

Referring to FIG. 4, in some embodiments, the acoustic horn 40 is structurally symmetrical about a middle line M between the channels 46.

Figure 5:
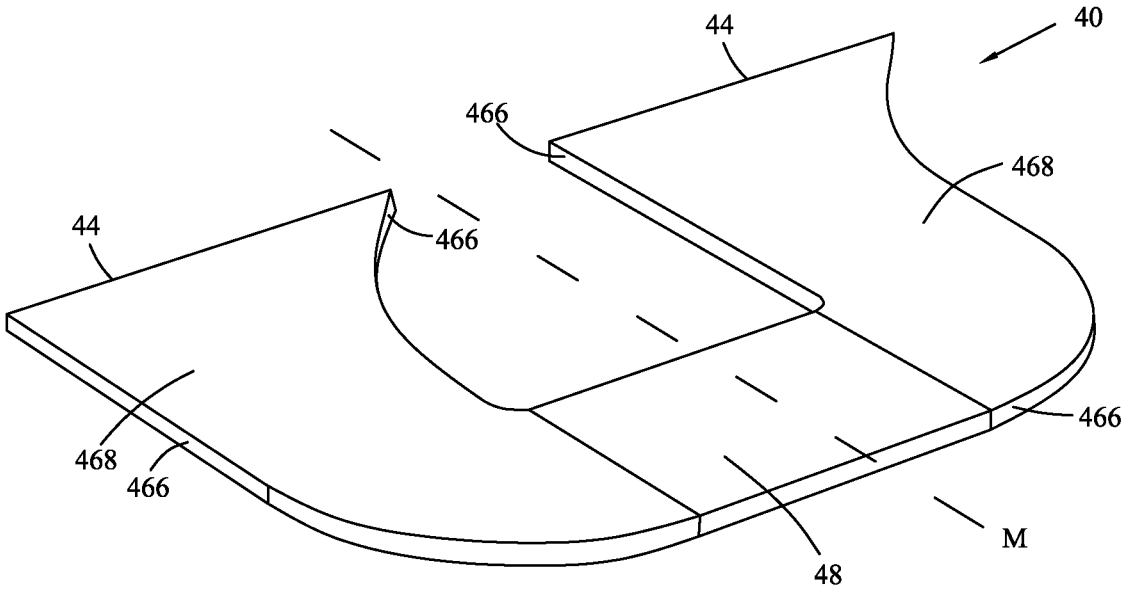
FIG. 5 is an isometric view of an acoustic horn in accordance with a third exemplary embodiment of the present disclosure.

Referring to FIG. 5, in some embodiments, ends of the adjacent two side walls 466 of the channels 46 close to the output ports 44 are spaced from each other. The acoustic horn 40 has a U-shaped configuration. The acoustic horn 40 is structurally asymmetrical about the middle line M between the channels 46. Portions of the channels 46 close to the mounting portion 48 are structurally symmetrical about the middle line M while the other portions of the channels 46 away from the mounting portion 48 have substantially the same shape. One of the adjacent two side walls 466 of the channels 46 is parallel to the middle line M between the channels 46 and a distance between the middle line M and the other of the adjacent two side walls 466 of the channels 46 decreases gradually in the direction from the mounting portion 48 to the output port 44.

Figure 6:
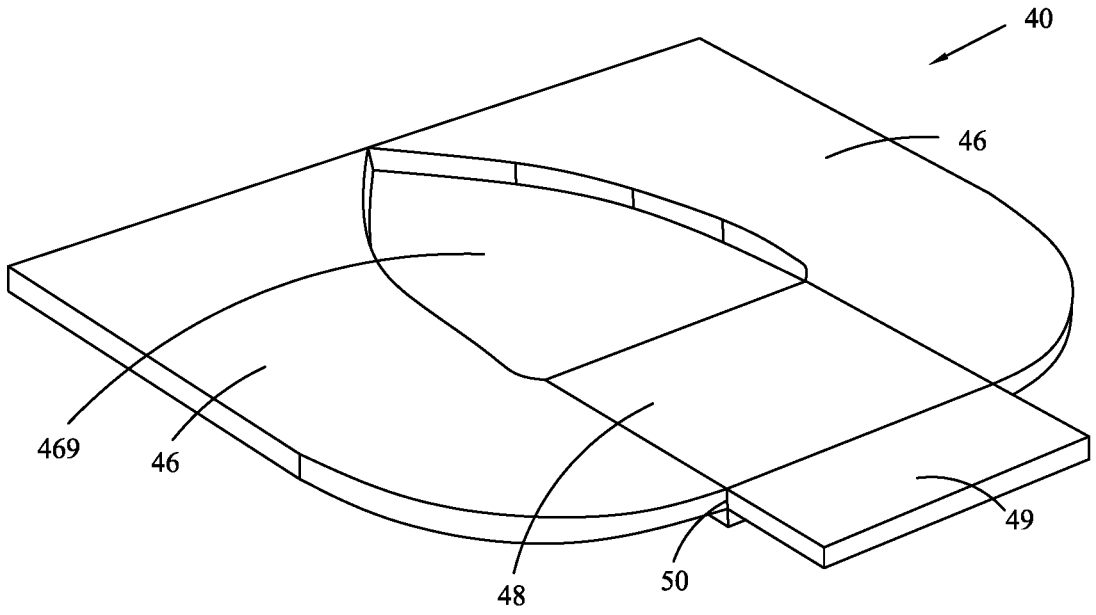
FIG. 6 to FIG. 8 illustrate a variety of acoustic horns with one or more extension cavities.

Referring to FIG. 6, in some embodiments, the horn 40 further comprises an extension cavity 49 connected to the mounting portion 48. The extension cavity 49 has sufficient damping for reducing unwanted resonances. Specifically, the extension cavity 49 is connected to a side of the mounting portion 48 away from the space 469 and communicated with inside of the mounting portion 48. Preferably, a sound absorptive layer 50 is covered on a side of the extension cavity 49 connected to the mounting portion 48, which facilities to reduce the sharpest resonance peaks. The sound absorptive layer 50 may be made of acoustical mesh material.

Figure 7:
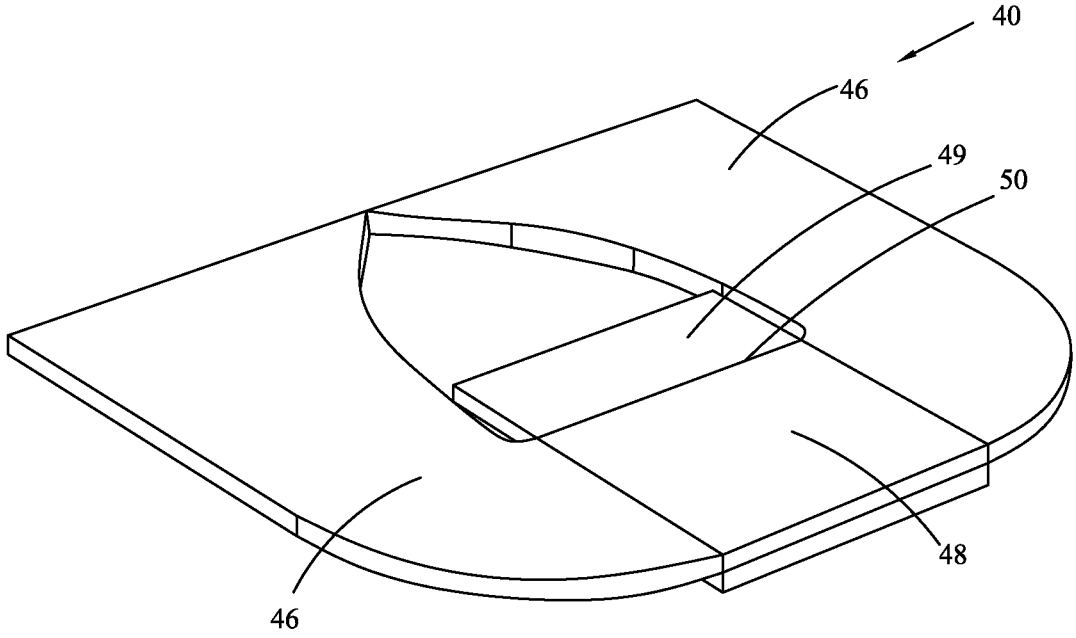

Referring to FIG. 7, in some embodiments, the extension cavity 49 is connected to a side of the mounting portion adjacent the space 469.

Figure 8:
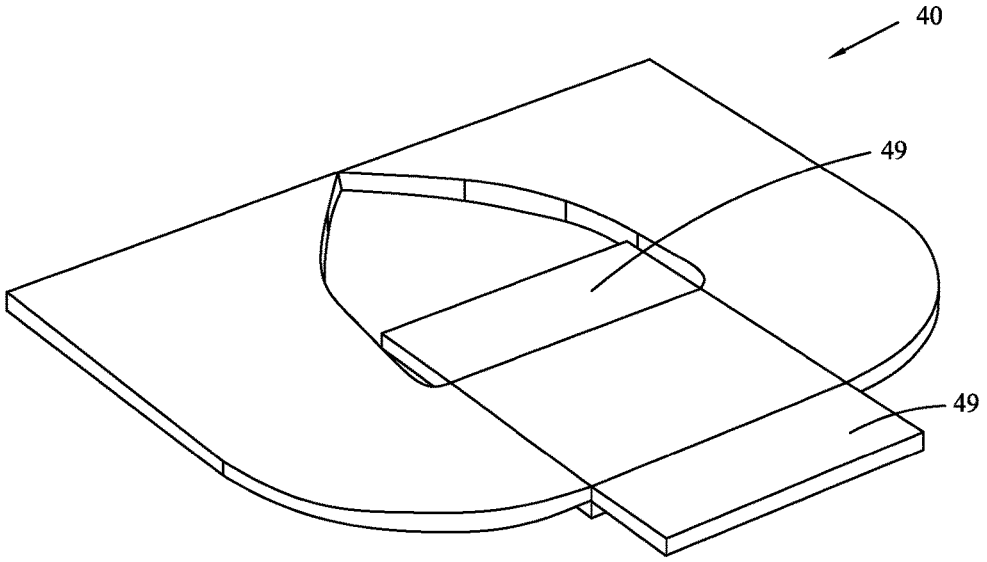

Referring to FIG. 8, in some embodiments, the horn 40 comprises two extension cavities 49 respectively connected to two sides of the mounting portion 48.

Figure 9A:
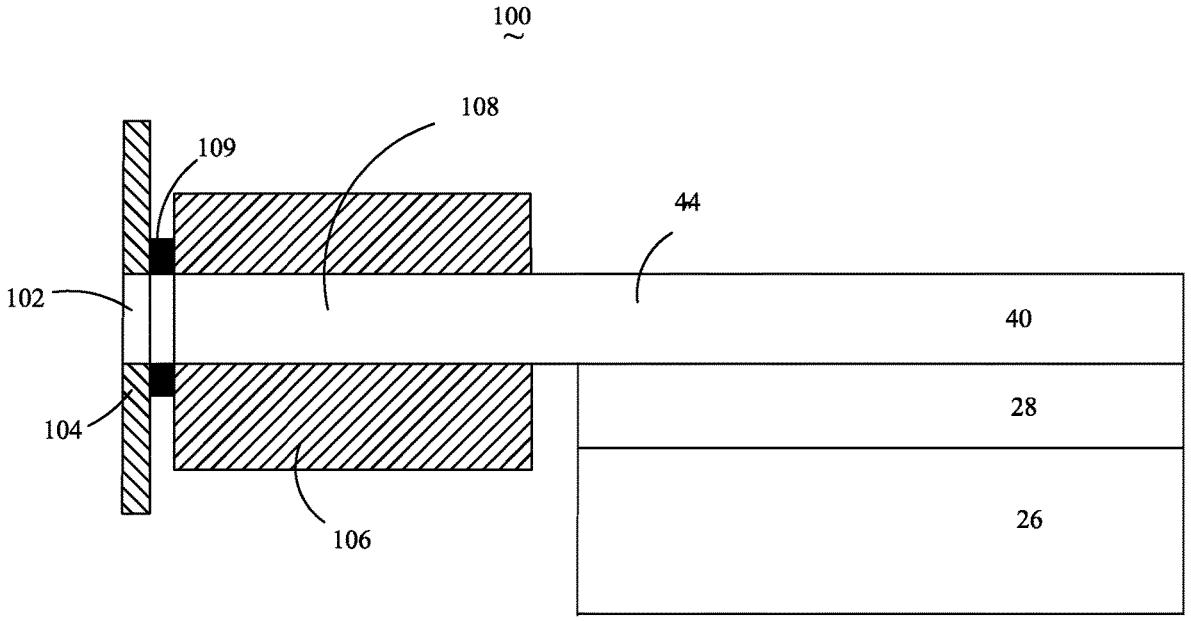
FIGS. 9*a*-9*d* illustrate portable electronic devices respectively incorporating a loudspeaker module in accordance with an exemplary embodiment of the present disclosure.

Referring to FIG. 9*a*, in some embodiments, the output ports 44 of the horn 40 and the outlet hole 102 of the device 100 that applies the loudspeaker module 10 are at the same level in the depth direction of the horn 40. That is, the middle line of the output ports 44 in the depth direction is coplanar with the middle line of the of the outlet hole 102 of the device 100. The device 100 comprises an enclosure 104 and an inner frame or body 106. The outlet hole 102 passes through the enclosure 104. The inner frame or body 106 defines a passage 108 which communicates the output ports 44 of the horn 40 with the outlet hole 102 of the device 100. The passage 108 extends horizontally in a direction perpendicular to the depth direction of the horn 40. A sealing 109 such as a gasket or adhesive is sandwiched between the inner frame or body 106.

Figure 9B:
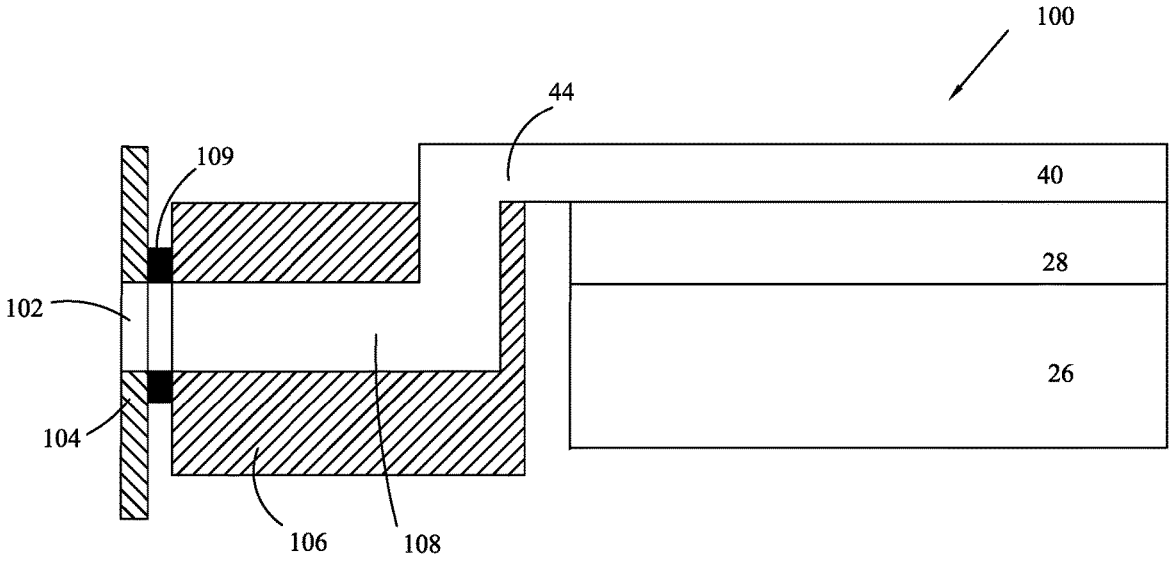

Referring to FIG. 9*b*, in some embodiments, the output ports 44 of the horn 40 and the outlet hole 102 of the device 100 may be at different levels at the depth direction of the horn 40. That is, the middle line of the output ports 44 in the depth direction is not coplanar with the middle line of the of the outlet hole 102 of the device 100. In this embodiment, the inner frame or body 106 defines an L-shaped passage 108 which communicates the output ports 44 of the horn 40 with the outlet hole 102 of the device 100.

Figure 9C:
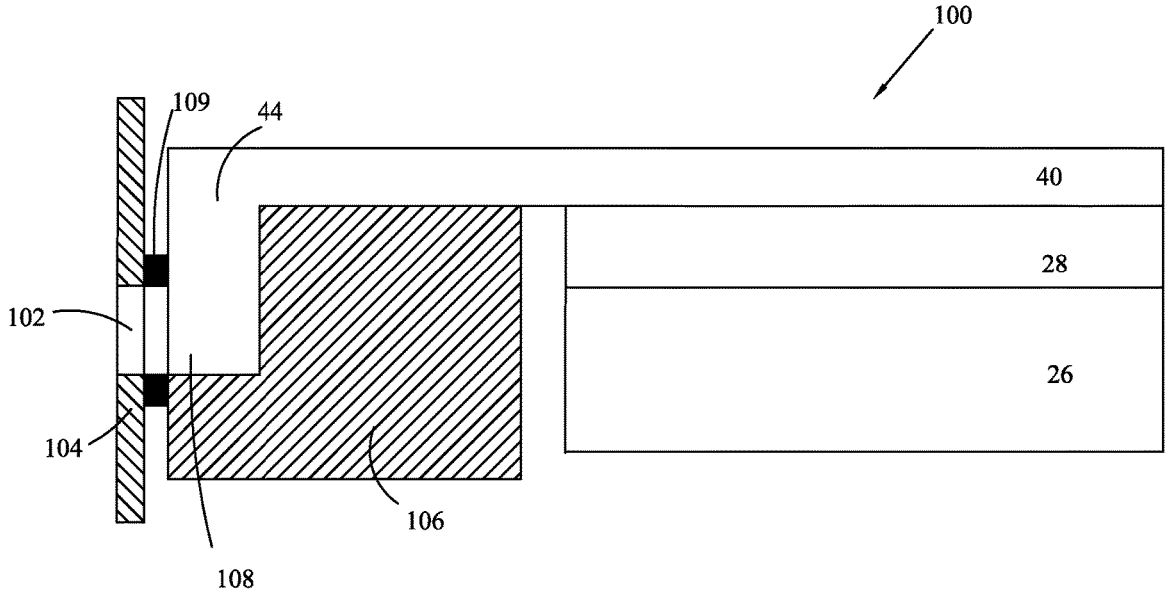

Referring to FIG. 9*c*, in some embodiments, the passage 108 extends vertically in a direction parallel to the depth direction of the horn 40.

Figure 9D:
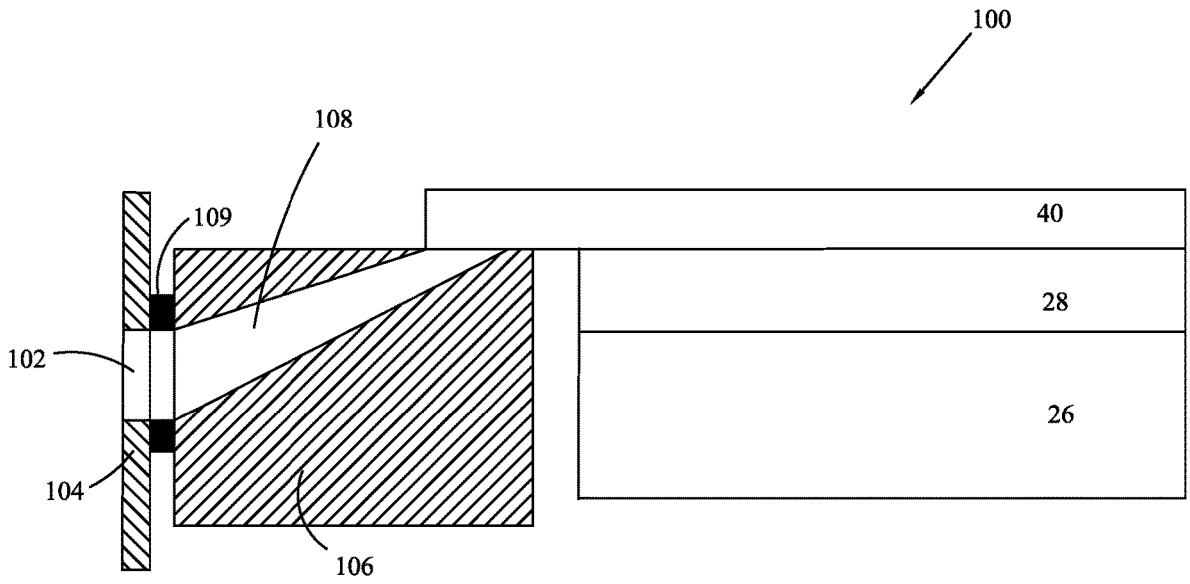

Referring to FIG. 9*d*, in some embodiments, the passage 108 extends inclinedly with respect to the depth direction of the horn 40. Preferably, an inclined guiding plate 109 is arranged at the output port 44 for guiding sound wave from the output port 44 to the passage 108.

Figure 10A:
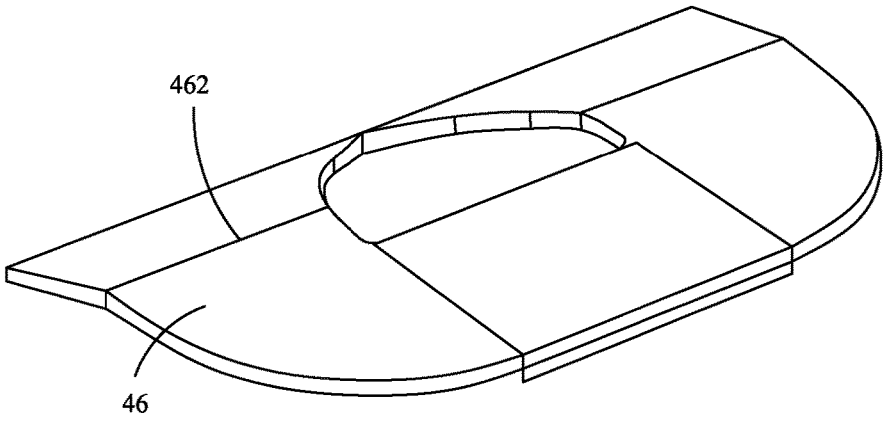
FIG. 10*a* and FIG. 10*b* illustrate acoustic horns of which the channels are bent with one or more bending portions.
Figure 10B:
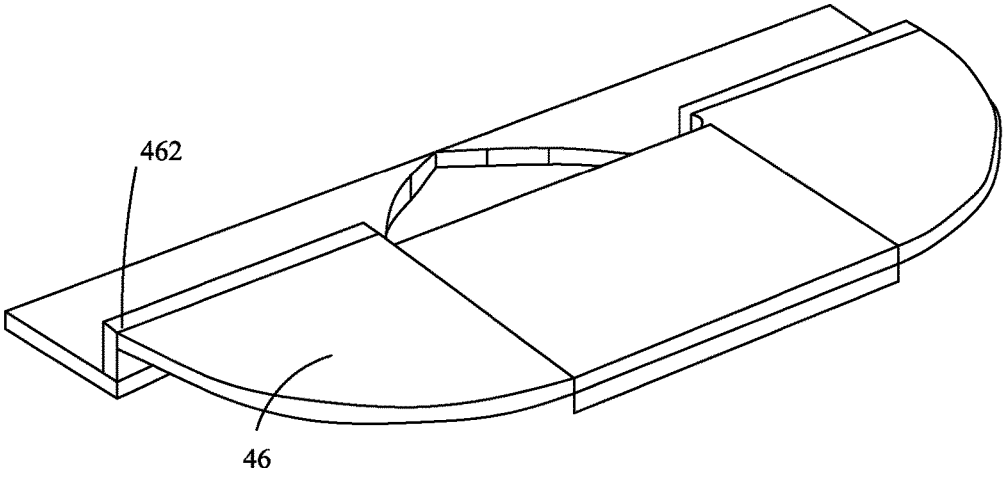

The channels 46 of the horn 40 may be straight, or bent/folded with one or more bending portion 462 as shown in FIG. 10*a* and FIG. 10*b*.

Figure 11A:
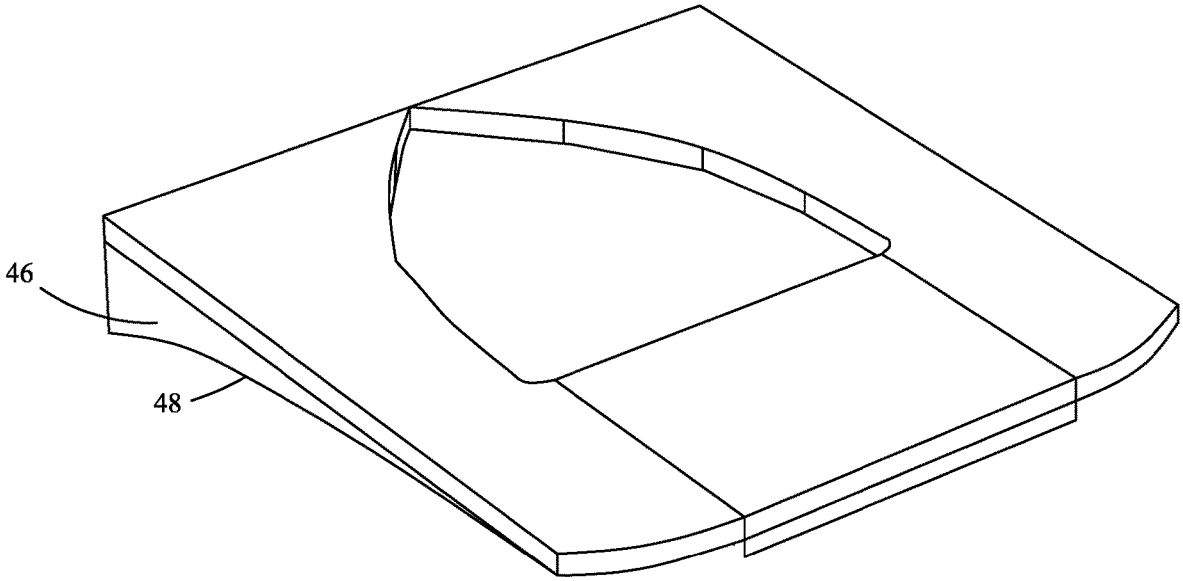
FIG. 11*a* and FIG. 11*b* illustrate acoustic horns, one of the connecting walls of the channels being bent to form a concaved arc configuration.
Figure 11B:
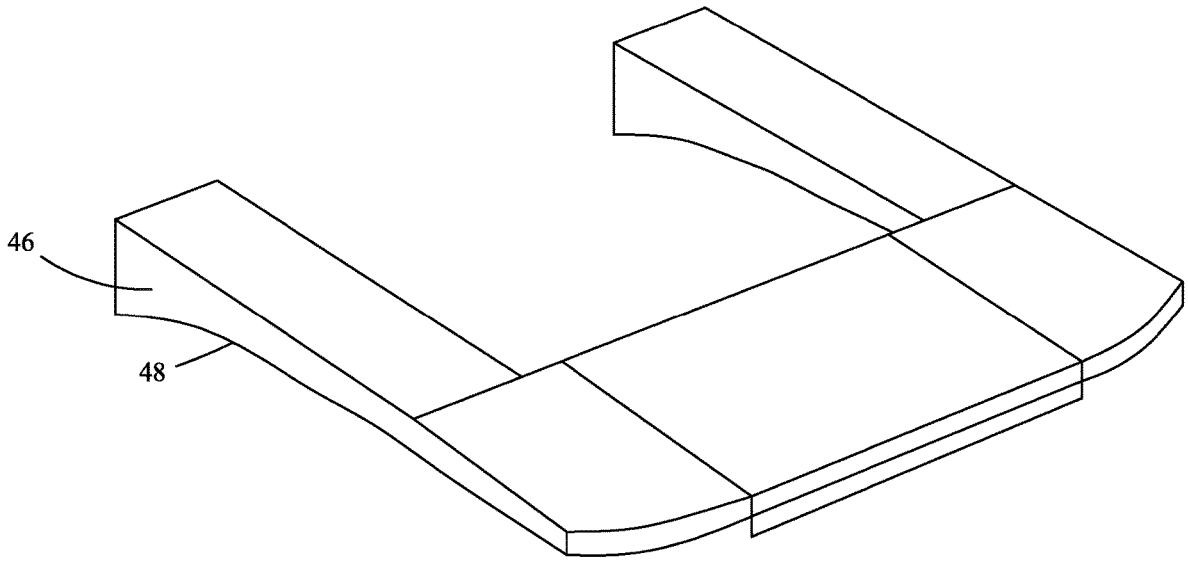

The channels 46 may have a uniform depth. Alternatively, the channels 46 may have non-uniform depth. In some embodiments, the depth of the channel 46 increases gradually in the direction from the driver/mounting portion to the output ports 44. As shown in FIG. 11*a* and FIG. 11*b*, the connecting walls 48 of the channel 46 are bent to form a concaved arc configuration such that the depth of the channels 46 increases gradually in the direction from the driver/mounting portion to the output ports 44. In the embodiment as shown in FIG. 11*b*, the channels 46 have uniform width.

Figure 12A:
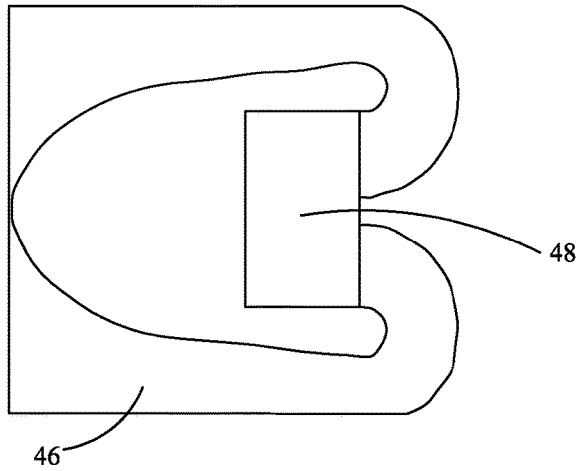
FIG. 12*a* and FIG. 12*b* illustrate acoustic horns of which the channels are bent around the driver.
Figure 12B:
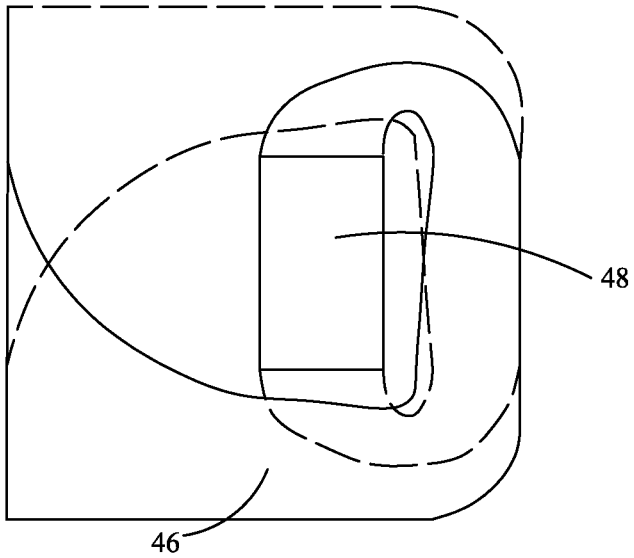

Referring to FIGS. 12*a*-12*b*, in some embodiments, under the condition that the inner space of the device 100, for example tablets or personal computers, is available, the length of the channels 46 can be extended by bending the channels 46 around the mounting portion 48 which is attached on the driver. The bended channels 46 can be also in two layers with one on top of the other, as illustrated in FIG. 12*b*.

In the present disclosure, the electronic device 100 may be a mobile phone, a PAD, a laptop and so on.

The present disclosure enables the use of acoustical horns within the space available in portable electronic devices. Measurements and listening tests prove that the desired high-frequency performance can be achieved and distortion at low frequencies is reduced. The acoustic horn 40 improves the acoustical loading at the highest frequencies, and overcome the issue of the physical distance between the loudspeaker enclosure and the exterior surface of the portable electronic device.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated above should not be interpreted as limits to the present invention, and the scope of the invention is to be determined by reference to the claims that follow.

What is claimed is:

1. An acoustic horn comprising:

an input port configured to acoustically couple with a front cavity of a loudspeaker;

a pair of output ports leading to exterior of the horn; and a pair of channels each communicating the input port with a corresponding output port;

wherein each of the channels has a cross section of which the area increases gradually in a direction from the input port to the corresponding output port and the areas of the cross sections of the channels in the same plane are substantially equal to each other such that the channels are acoustical symmetrical, each of the channels comprises a pair of spaced side walls and a pair spaced connecting walls respectively connected between opposite ends of the side walls, a path is formed between the side walls and the connecting walls, and at least one of the side walls and the connecting walls is curved or bent with at least one bending portion.

2. The acoustic horn of claim 1, wherein a distance between the adjacent two side walls of the channels decreases gradually in the direction from the input port to the corresponding output port.

3. The acoustic horn of claim 1, wherein the acoustic horn is structurally symmetrical about a middle line between the channels.

4. The acoustic horn of claim 1, wherein the acoustic horn is structurally asymmetrical about a middle line between the channels.

5. The acoustic horn of claim 1, wherein ends of the adjacent two side walls of the channels close to the output ports are spaced from each other; or ends of the adjacent two side walls of the channels close to the output ports are connected to each other.

6. The acoustic horn of claim 1, wherein portions of the channels adjacent to the input port are structurally symmetrical and other portions of the channels away from the input port have the same shape.

7. The acoustic horn of claim 1, wherein the acoustic horn further comprises at least one extension cavity communicated with the input port and a sound absorptive layer is covered on a side of the extension cavity.

8. A loudspeaker module comprising:

a loudspeaker comprising:

a front cavity with sound holes communicating with the front cavity;

a rear cavity; and a driver located between the front cavity and the rear cavity; and an acoustic horn attached to the loudspeaker, the acoustic horn comprising:

an input port communicated with the front cavity via the sound holes;

a pair of output ports leading to exterior of the acoustic horn; and a pair of channels each communicating the input port with a corresponding one of the output ports;

wherein the channel has a cross section of which the area increases gradually in a direction from the input port to the corresponding output port and the areas of the cross sections of the channels in the same plane are substantially equal to each other, each of the channels comprises a pair of side walls and a pair connecting walls respectively connected between opposite ends of the side walls, a space is formed between adjacent two side walls of the channels, and a distance between the adjacent two side walls of the channels decreases gradually in the direction.

9. The loudspeaker module of claim 8, wherein the acoustic horn is structurally symmetrical about a middle line between the channels; or the acoustic horn is structurally asymmetrical about a middle line between the channels.

10. The loudspeaker module of claim 8, wherein ends of the adjacent two side walls of the channels close to the output ports are connected to each other; or ends of the adjacent two side walls of the channels close to the output ports are spaced from each other.

11. The loudspeaker module of claim 8, wherein one of the adjacent two side walls of the channels is parallel to a middle line between the channels and a distance between the middle line and the other of the adjacent two side walls of the channels decreases gradually in the direction.

12. The loudspeaker module of claim 8, wherein the horn further comprises a hollow mounting portion located between the channels which are connected to opposite sides of the mounting portion, and the input port is defined in another side of the mounting portion attached to the loudspeaker.

13. The loudspeaker module of claim 12, wherein the hollow mounting portion has a cavity with a height in a range of 0.7 mm to 1 mm.

14. An acoustic horn comprising:

an input port configured to acoustically couple with a front cavity of a loudspeaker;

a pair of output ports leading to exterior of the horn; and a pair of channels each communicating the input port with a corresponding output port;

wherein each of the channels has a cross section of which the area increases gradually in a direction from the input port to the corresponding output port and the areas of the cross sections of the channels in the same plane are substantially equal to each other such that the channels are acoustical symmetrical, the cross section is rectangle and comprises a pair of width edges and a pair of depth edges, and sizes of the width edges of the cross sections of the channels located at the same plane are substantially equal to each other.

15. The acoustic horn of claim 14, wherein sizes of the width edges increases gradually in the direction from the input port to the corresponding output port; or sizes of the depth edges increases gradually in the direction from the input port to the corresponding output port.

16. The acoustic horn of claim 14, wherein the acoustic horn further comprises at least one extension cavity communicated with the input port and a sound absorptive layer is covered on a side of the extension cavity.

* * * * *